US005913467A

United States Patent [19]

Berg

[11] Patent Number: 5,913,467

[45] Date of Patent: Jun. 22, 1999

[54] MOUNTING SYSTEM FOR SECURING A PAIR OF MAIN SCUBA TANKS TO A BACK PLATE

[76] Inventor: Daniel T. Berg, 2745 Cheshire Dr., Baldwin, N.Y. 11510

[21] Appl. No.: 08/992,725

[22] Filed: Dec. 17, 1997

[51] Int. Cl.[6] ..... A45F 3/10

[52] U.S. Cl. ..... 224/628; 224/148.6; 224/651; 224/250; 128/205.22; 405/186

[58] Field of Search ..... 224/148.1, 148.41, 224/148.7, 627, 628, 633, 645, 650, 651, 250; 128/205.22; 114/315; 405/185, 186; 248/74.3, 315

[56] References Cited

U.S. PATENT DOCUMENTS

| | | | |
|---|---|---|---|
| 2,764,151 | 9/1956 | Cupp | 128/205.22 |
| 2,943,775 | 7/1960 | Mack | 224/628 |
| 3,035,747 | 5/1962 | Ullrich, Jr. | 224/262 X |
| 3,191,828 | 6/1965 | Senne | 224/628 X |
| 3,483,865 | 12/1969 | Jansson et al. | 128/205.2 |
| 3,842,611 | 10/1974 | Anderson | 114/315 X |
| 4,640,215 | 2/1987 | Purifoy, Jr. | 128/205.22 X |
| 4,690,314 | 9/1987 | Faulconer et al. | 224/628 |
| 4,889,306 | 12/1989 | Boucher | 114/315 X |
| 5,127,399 | 7/1992 | Scholley | 128/205.22 |
| 5,474,269 | 12/1995 | Kasubke | 248/74.3 X |
| 5,579,967 | 12/1996 | Berg | 224/250 |

*Primary Examiner*—Gregory M. Vidovich
*Attorney, Agent, or Firm*—Richard L. Miller, P. E.

[57] ABSTRACT

A mounting system for releasably securing a pair of main scuba tanks to a wing style back plate having an upper portion and a lower portion. The system includes upper and lower band assemblies for securing the pair of main scuba tanks to the upper and lower portions, respectively, of the wing style back plate. Each of the upper and lower band assemblies includes a pair of bands, each of which passes through a bracket that mounts to the wing style back plate and releasably encircles one tank of the pair of main scuba tanks with one end thereof having a hook thereon and the other end thereof having a quick release cam buckle thereon for releasably engaging the hook.

10 Claims, 2 Drawing Sheets

FIG. 1
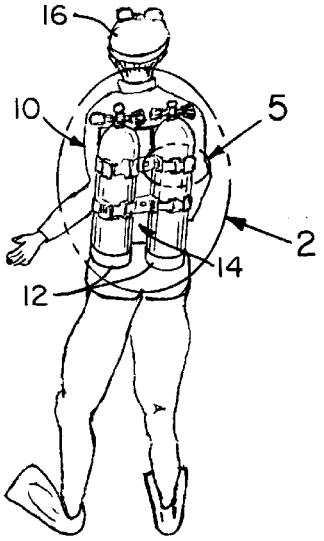
FIG. 2
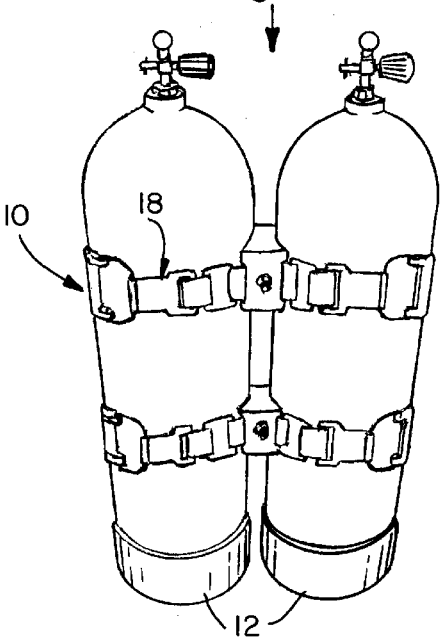
FIG. 3
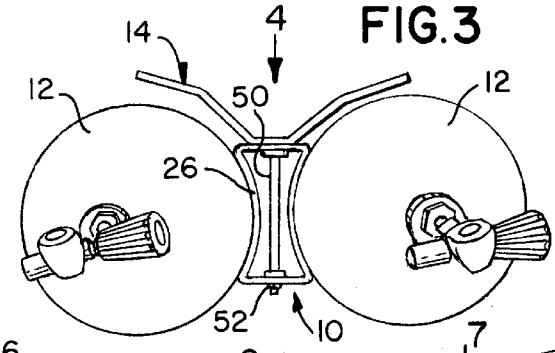
FIG. 4
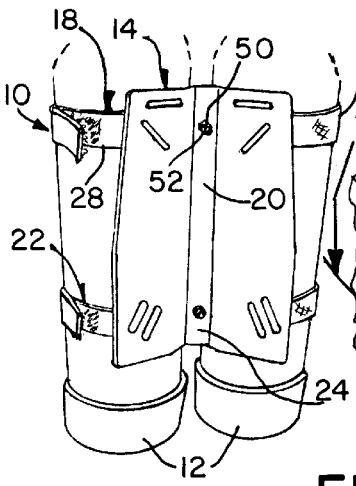
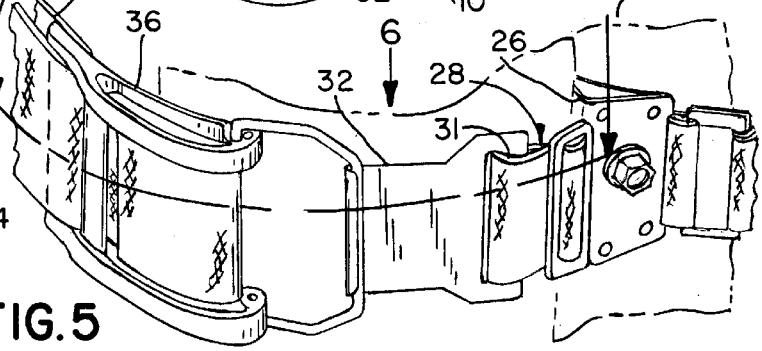
FIG. 5

8
12
26
28
31
32
34
36
38
40
42
44
45
46
48
50
52
54
56
58
60
62
64
66

MOUNTING SYSTEM FOR SECURING A PAIR OF MAIN SCUBA TANKS TO A BACK PLATE

BACKGROUND OF THE INVENTION

1. Field of the Invention

The present invention relates to a mounting system. More particularly, the present invention relates to a mounting system for securing a pair of main scuba tanks to a back plate.

2. Description of the Prior Art

Innovations for scuba tank mounting systems have been provided in the prior art that will be described. Even though these innovations may be suitable For the specific individual purposes to which they address, however, they differ from the present invention.

FOR EXAMPLE, in my U.S. Pat. No. 5,579,967 to Berg I teach a pony tank mounting system comprising a joining bracket and components for securing the joining bracket to a pony tank. A structure is provided for suspending the joining bracket with the pony tank from a valve on a main scuba tank along with an assembly for attaching the joining bracket with the pony tank to the main scuba tank, whereby a diver may quickly don or doff the pony tank.

It is apparent that innovations for scuba tank mounting systems have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

ACCORDINGLY, AN OBJECT of the present invention is to provide a mounting system for securing a pair of main scuba tanks to a back plate that avoids the disadvantages of the prior art.

ANOTHER OBJECT of the present invention is to provide a mounting system for securing a pair of main scuba tanks to a back plate that is simple and inexpensive to manufacture.

STILL ANOTHER OBJECT of the present invention is to provide a mounting system for securing a pair of main scuba tanks to a back plate that is simple to use.

BRIEFLY STATED, YET ANOTHER OBJECT of the present invention is to provide a mounting system for releasibly securing a pair of main scuba tanks to a wing style back plate having an upper portion and a lower portion. The system includes upper and lower band assemblies for securing the pair of main scuba tanks to the upper and lower portions, respectively, of the wing style back plate. Each of the upper and lower band assemblies includes a pair of bands, each of which passes through a bracket that mounts to the wing style back plate and releasibly encircles one tank of the pair of main scuba tanks with one end thereof having a hook thereon and the other end thereof having a quick release cam buckle thereon for releasibly engaging the hook.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures on the drawing are briefly described as follows:

FIG. 1 is a diagrammatic perspective view of the present invention securing a pair of main scuba tanks to a wing style back plate donned by a scuba diver;

FIG. 2 is an enlarged diagrammatic perspective view of the area generally enclosed by the dotted ellipse identified by arrow 2 in FIG. 1;

FIG. 3 is an enlarged diagrammatic top plan view taken generally in the direction of arrow 3 in FIG. 2, with the buckles and straps of the upper strap assembly removed for clarity;

FIG. 4 is a reduced diagrammatic perspective view taken generally in the direction of arrow 4 in FIG. 3;

FIG. 5 is an enlarged diagrammatic perspective view of the area generally enclosed by the dotted ellipse identified by arrow 5 in FIG. 1;

LIST OF REFERENCE NUMERALS UTILIZED IN THE DRAWING

Figures 6, 7, 8, 9:
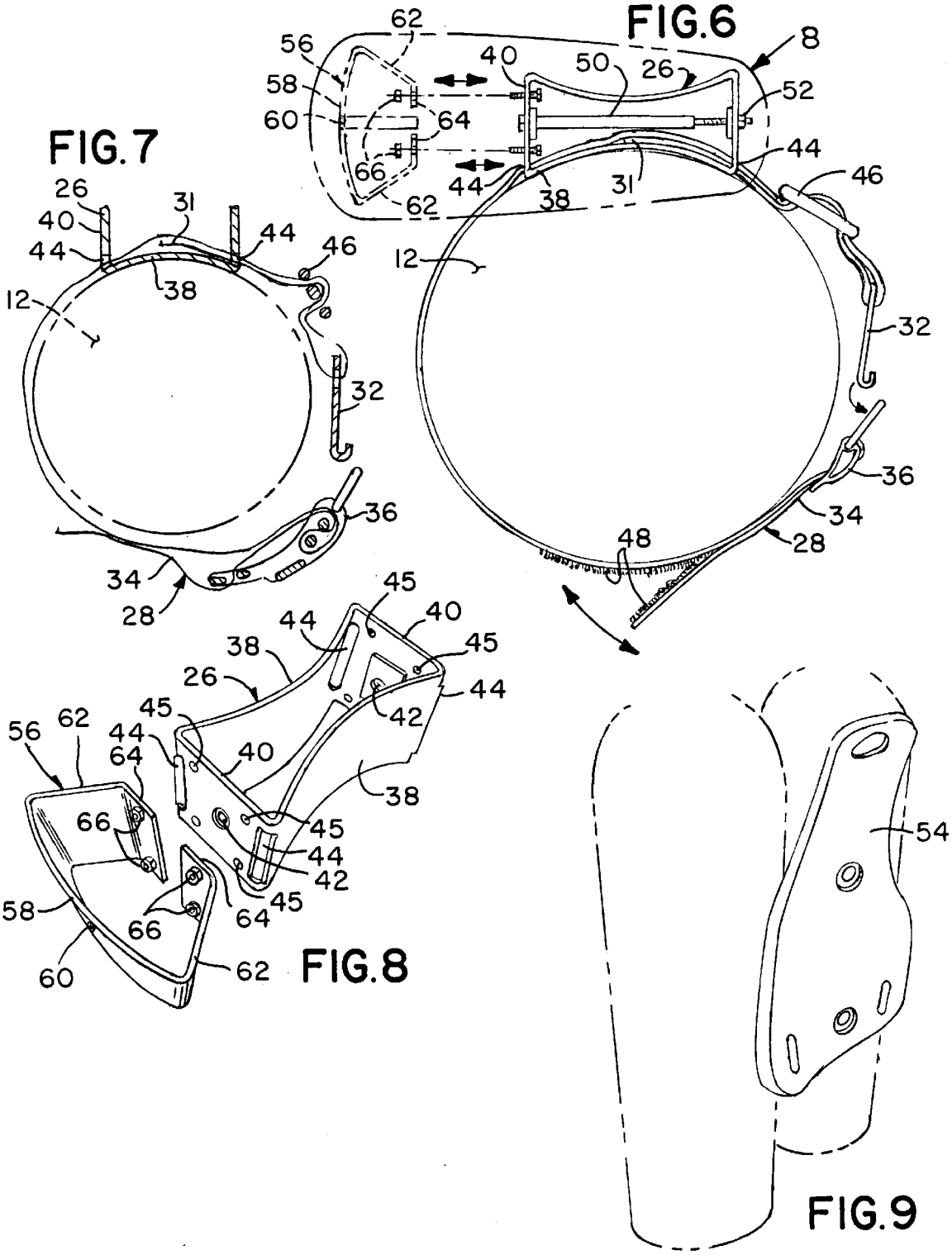
FIG. 6 is a diagrammatic top plan view taken generally in the direction of arrow 6 in FIG. 5.
FIG. 7 is a reduced cross sectional view taken on line 7—7 in FIG. 5.
FIG. 8 is a exploded diagrammatic perspective view of the area generally enclosed by the dotted ellipse identified by arrow 8 in FIG. 6.
FIG. 9 is diagrammatic perspective view of a standard back pack with a pair of scuba tanks.

10 mounting system for securing a pair of main scuba tanks 10
12 pair of main scuba tanks
14 wing style back plate
16 scuba diver
18 upper band assembly
20 upper portion of the wing style back plate 14.
22 lower band assembly
24 lower portion of the wing style back plate 14.
26 bracket of upper band assembly 18
28 first band of upper band assembly 18
30 second band of upper band assembly 18
31 one end of first band 28 of upper band assembly 18
32 hook of upper band assembly 18
34 other end of first band 28 of upper band assembly 18
36 plastic cam buckle of first band 28 of upper band assembly 18
38 pair of opposing side walls of bracket 26 of upper band assembly 18
40 pair of opposing end walls of bracket 26 of upper band assembly 18
42 centrally-aligned throughbore 42 in each end wall of pair of opposing end walls 40 of bracket 26 of upper band assembly 18
44 pair of throughslots in each end wall of pair of opposing end walls 40 of bracket 26 of upper band assembly 18
45 four throughbores in each end wall of pair of opposing end walls 40 of bracket 26 of upper band assembly 18
46 tension clip of upper band assembly 18
48 hook and hoop fasteners of upper band assembly 18
50 bolt of upper band assembly 18
52 nut of upper band assembly 18
54 backpack
56 adapter of upper band assembly 18
58 nose wall of adapter 56 of upper band assembly 18
60 throughbore in nose wall 58 of adapter 56 of upper band assembly 18
62 pair of side walls of adapter 56 of upper band assembly 18

64 pair of base walls of adapter 56 of upper band assembly 18

66 four nuts and bolts of upper band assembly 18.

DETAILED DESCRIPTION OF THE PREFERRED EMBODIMENT

Referring now to the figures in which like numerals indicate like parts, and particularly to FIGS. 1–3, the mounting system for securing a pair of main scuba tanks to a back plate of the present invention is shown generally at 10 securing a pair of main scuba tanks 12 to a wing style back plate 14 donned by a scuba diver 16.

As shown in FIG. 4, the mounting system for securing a pair of main scuba tanks to a back plate 10 comprises an upper band assembly 18 for releasibly securing the pair of main scuba tanks 12 to an upper portion 20 of the wing style back plate 14 and a lower band assembly 22 for releasibly securing the pair of main scuba tanks 12 to a lower portion 24 of the wing style back plate 14.

The upper band assembly 18 and the lower band assembly 22 are identical, so for the sake of brevity, only the upper band assembly 18 will be discussed.

As shown in FIGS. 3 and 5–7, the upper band assembly 18 comprises a bracket 26 for disposition between the pair of main scuba tanks 12 and for attachment to the upper portion 20 of the wing style back plate 14.

The upper band assembly 18 further comprises a first band 28 that is nylon webbing for releasibly encircling one main scuba tank of the pair of main scuba tanks 12 and passes through the bracket 26, and a second band 30 that is nylon webbing and independent of the first band 28 for releasibly encircling the other main scuba tank of the pair of main scuba tanks 12 and also passing through the bracket 26.

The first band 28 and the second band 30 are identical, so for the sake of brevity, only the first band 28 will be discussed.

The first band 28 passes through the bracket 26, with one end 31 thereof having a hook 32 adjustably affixed thereon that is stainless steel, around a main tank of the pair of main tanks 12, and with the other end 34 thereof having a cam buckle 36 adjustably affixed thereon that is quick release and plastic for releasibly engaging the hook 32 at the back of the main tank of the pair of main tanks 12.

As shown in FIG. 8, the bracket 26 is defined by a four-sided continuous periphery and comprises a pair of opposing side walls 38 that are concave and are connected to each other, at their ends, by a pair of opposing end walls 40 that are flat and parallel.

Each end wall of the pair of opposing end walls 40 of the bracket 26 has a centrally-aligned throughbore 42, a pair of throughslots 44 that are parallel and extend along and adjacent to where the end wall 40 connects to the pair of opposing side walls 38 of the bracket 26, and four throughbores 45 at its corners.

As shown in FIGS. 3, 4 and 6 the bracket 26 of the first band assembly is attached to the upper portion 20 of the wing style back plate 14 by a bolt 50 that passes through the upper portion 20 of the wing style back plate 14, through the centrally-disposed throughbore 42 in one end wall of the pair of opposing end walls 40 of the bracket 26, through the centrally-disposed throughbore 42 in the other end wall of the pair of opposing end walls 40 of the bracket 26, and engages a lock nut 52 that is nylon.

As shown in FIGS. 6 and 7, one main scuba tank of the pair of main scuba tanks is seated against one side wall of the pair of opposing side walls 38 of the bracket 26.

The one end 31 of the first band 28 extends through one throughslot of the pair of throughslots 44 in one end wall of the pair of opposing end walls 40 of the bracket 26, along the inner side of an associated side wall of the pair of opposing side walls 38 of the bracket 26, out an aligned throughslot of the pair of throughslots 44 in the other end wall of the pair of opposing end walls 40 of the bracket 26, through a tension clip 46, through the hook 32, back through the tension clip 46, and back through the aligned throughslot of the pair of throughslots 44 in the other end wall of the pair of opposing end walls 40 of the bracket 26, where it terminates, while the other end 34 of the first band 28 passes through the cam buckle 36 and doubles back on to itself, where it is maintained thereat by hook and hoop fasteners 48 so as to allow the cam buckle 36 to be released from the hook 32 by merely lifting the other end 34 of the first band 28, detaching the hook and loop fasteners 48, and continuing to lift the other end 34 of the first band 28 until the cam buckle 36 disengages from the hook 32.

As shown in FIGS. 8 and 9, when the first band assembly is to be attached to a backpack 54 instead of the wing style back plate 14, an adapter 56 must be utilized.

As shown in FIGS. 6 and 8, the adaptor 56 comprises a nose wall 58 that is convexo-concave-shaped for abutting against the backpack 54 and has a throughbore 60 that passes centrally therethrough for alignment with the centrally-disposed throughbore 42 in the one end wall of the pair of opposing end walls 40 of the bracket 26, a pair of side walls 62 that converge from the nose wall 58 of the adapter, at its ends, and a pair of base walls 64 that are coplanar and extend inwardly from the pair of side walls 62 of the adapter 56, at its ends, with each base wall of the pair of base walls 64 of the adapter 56 having a pair of throughbores 66 for alignment with the four throughbores 45 in the one end wall of the pair of opposing end walls 40 of the bracket 26, and are maintained thereat by four nuts and bolts 66 passing therethrough.

It will be understood that each of the elements described above, or two or more together, may also find a useful application in other types of constructions differing from the types described above.

While the invention has been illustrated and described as embodied in a mounting system for securing a pair of main scuba tanks to a back plate, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A mounting system for securing a pair of main scuba tanks to a wing style back plate having an upper portion and a lower portion, comprising:

a) an upper band assembly for releasibly securing the pair of main scuba tanks to the upper portion of the wing style back plate; said upper band assembly comprising a bracket for disposition between the pair of main scuba tanks and for attachment to the upper portion of the wing style back plate; said upper band assembly further comprising a first band for releasibly encircling one main scuba tank of the pair of main scuba tanks and passing through said bracket of said upper band assembly, and a second band being independent of said first band of said upper band assembly for releasibly encircling the other main scuba tank of the pair of main scuba tanks and also passing through said bracket of said upper band assembly; said first band of said upper band assembly passing through said bracket of said upper band assembly, with one end thereof having a hook adjustable affixed thereon, and with the other end thereof having a cam buckle adjustably affixed thereon for releasibly engaging said hook of said first band of said upper band assembly; said second band of said upper band assembly passing through said bracket of said upper band assembly, with one end thereof having a hook adjustably affixed thereon, and with the other end thereof having a cam buckle adjustably affixed thereon for releasibly engaging said hook of said second band of said upper band assembly; said bracket of said upper band assembly being defined by a four-sided continuous periphery and comprising a pair of opposing side walls being concave and connecting to each other, at their ends, by a pair of opposing end walls being flat and parallel; each end wall of said pair of opposing end walls of said bracket of said upper band assembly having a centrally-aligned throughbore, a pair of throughslots being parallel and extending along and adjacent to where said end wall connects to said pair of opposing side walls of said bracket of said upper band assembly, and four throughbores at its corners; and b) a lower band assembly independent of said upper band assembly for releasibly securing the pair of main scuba tanks to the lower portion of the wing style back plate; said lower band assembly comprising a bracket for disposition between the pair of main scuba tanks and for attachment to the lower portion of the wing style back plate; said lower band assembly further comprising a first band for releasibly encircling the one main scuba tank of the pair of main scuba tanks and passing through said bracket of said lower band assembly, and a second band that is independent of said first band of said lower band assembly for releasibly encircling the other main scuba tank of the pair of main scuba tanks and also passing through said bracket of said lower band assembly; said first band of said lower band assembly passing through said bracket of said lower band assembly, with one end thereof having a hook adjustably affixed thereon, and with the other end thereof having a cam buckle adjustable affixed thereon for releasibly engaging said hook of said first band of said lower band assembly; said second band of said lower band assembly passes through said bracket of said lower band assembly, with one end thereof having a hook adjustably affixed thereon, and with the other end thereof having a cam buckle adjustably affixed thereon for releasibly engaging said hook of said second band of said lower band assembly; said bracket of said lower band assembly being defined by a four-sided continuous periphery and comprising a pair of opposing side walls being concave and connecting to each other, at their ends, by a pair of opposing end walls being flat and parallel; each end wall of said pair of opposing end walls of said bracket of said lower band assembly having a centrally-aligned throughbore, a pair of throughslots being parallel and extending along and adjacent to where said end wall connects to said pair of opposing side walls of said bracket of said lower band assembly, and four throughbores at its corners.

2. The system as defined in claim 1, wherein said bracket of said upper band assembly is adapted to be attached to the upper portion of the wing style back plate by a bolt that passes through the upper portion of the wing style back plate, through said centrally-disposed throughbore in one end wall of said pair of opposing end walls of said bracket of said upper band assembly, through said centrally-disposed throughbore in the other end wall of said pair of opposing end walls of said bracket of said upper band assembly, and engages a nut; said bracket of said lower band assembly is adapted to be attached to the lower portion of the wing style back plate by a bolt that passes through the lower portion of the wing style back plate, through said centrally-disposed throughbore in one end wall of said pair of opposing end walls of said bracket of said lower band assembly, through said centrally-disposed throughbore in the other end wall of said pair of opposing end walls of said bracket of said lower band assembly, and engages a nut.

3. The system as defined in claim 1, wherein one main scuba tank of the pair of main scuba tanks is adapted to be seated against one side wall of said pair of opposing side walls of said bracket of said upper band assembly and against one side wall of said pair of opposing side walls of said bracket of said lower band assembly; the other main scuba tank of the pair of main scuba tanks is adapted to be seated against the other side wall of said pair of opposing side walls of said bracket of said upper band assembly and against the other side wall of said pair of opposing side walls of said bracket of said lower band assembly.

4. The system as defined in claim 1, wherein said one end of said first band of said upper band assembly extends through one throughslot of said pair of throughslots in one end wall of said pair of opposing end walls of said bracket of said upper band assembly, along the inner side of an associated side wall of said pair of opposing side walls of said bracket of said upper band assembly, out an aligned throughslot of said pair of throughslots in the other end wall of said pair of opposing end walls of said bracket of said upper band assembly, through a tension clip of said first band of said upper band assembly, through said hook of said first band of said upper band assembly, back through said tension clip of said first band of said upper band assembly, and back through said aligned throughslot of said pair of throughslots in said other end wall of said pair of opposing end walls of said bracket of said upper band assembly, where it terminates, while said other end of said first band of said upper band assembly passes through said cam buckle of said first band of said upper band assembly and doubles back onto itself, where it is maintained thereat by hook and hoop fasteners of said first band of said upper band assembly so as to allow said cam buckle of said first band of said upper band assembly to be released from said hook of said first band of said upper band assembly by merely lifting said other end of said first band of said upper band assembly, detaching said hook and hoop fasteners of said first band of said upper band assembly, and continuing to lift said other end of said first band of said upper band assembly until said cam buckle of said first band of said upper band assembly disengages from said hook of said first band of said upper band assembly.

5. The system as defined in claim 4, wherein said one end of said second band of said upper band assembly extends through the other throughslot of said pair of throughslots in said one end wall of said pair of opposing end walls of said bracket of said upper band assembly, along the inner side of the other associated side wall of said pair of opposing side walls of said bracket of said upper band assembly, out the other aligned throughslot of said pair of throughslots in said other end wall of said pair of opposing end walls of said bracket of said upper band assembly, through a tension clip of said second band of said upper band assembly, through said hook of said second band of said upper band assembly, back through said tension clip of said second band of said upper band assembly, and back through said other aligned throughslot of said pair of throughslots in said other end wall of said pair of opposing end walls of said bracket of said upper band assembly, where it terminates, while said other end of said second band of said upper band assembly passes through said cam buckle of said second band of said upper band assembly and doubles back onto itself, where it is maintained thereat by hook and hoop fasteners of said second band of said upper band assembly so as to allow said cam buckle of said second band of said upper band assembly to be released from said hook of said second band of said upper band assembly by merely lifting said other end of said second band of said upper band assembly, detaching said hook and hoop fasteners of said second band of said upper band assembly, and continuing to lift said other end of said second band of said upper band assembly until said cam buckle of said second band of said upper band assembly disengages from said hook of said second band of said upper band assembly.

6. The system as defined in claim 1, wherein said one end of said first band of said lower band assembly extends through one throughslot of said pair of throughslots in one end wall of said pair of opposing end walls of said bracket of said lower band assembly, along the inner side of an associated side wall of said pair of opposing side walls of said bracket of said lower band assembly, out an aligned throughslot of said pair of throughslots in the other end wall of said pair of opposing end walls of said bracket of said lower band assembly, through a tension clip of said first band of said lower band assembly, through said hook of said first band of said lower band assembly, back through said tension clip of said first band of said lower band assembly, and back through said aligned throughslot of said pair of throughslots in said other end wall of said pair of opposing end walls of said bracket of said lower band assembly, where it terminates, while said other end of said first band of said lower band assembly passes through said cam buckle of said first band of said lower band assembly and doubles back onto itself, where it is maintained thereat by hook and hoop fasteners of said first band of said lower band assembly so as to allow said cam buckle of said first band of said lower band assembly to be released from said hook of said first band of said lower band assembly by merely lifting said other end of said first band of said lower band assembly, detaching said hook and hoop fasteners of said first band of said lower band assembly, and continuing to lift said other end of said first band of said lower band assembly until said cam buckle of said first band of said lower band assembly disengages from said hook of said first band of said lower band assembly.

7. The system as defined in claim 6, wherein said one end of said second band of said lower band assembly extends through the other throughslot of said pair of throughslots in said one end wall of said pair of opposing end walls of said bracket of said lower band assembly, along the inner side of the other associated side wall of said pair of opposing side walls of said bracket of said lower band assembly, out the other aligned throughslot of said pair of throughslots in said other end wall of said pair of opposing end walls of said bracket of said lower band assembly, through a tension clip of said second band of said lower band assembly, through said hook of said second band of said lower band assembly, back through said tension clip of said second band of said lower band assembly, and back through said other aligned throughslot of said pair of throughslots in said other end wall of said pair of opposing end walls of said bracket of said lower band assembly, where it terminates, while said other end of said second band of said lower band assembly passes through said cam buckle of said second band of said lower band assembly and doubles back onto itself, where it is maintained thereat by hook and hoop fasteners of said second band of said lower band assembly so as to allow said cam buckle of said second band of said lower band assembly to be released from said hook of said second band of said lower band assembly by merely lifting said other end of said second band of said lower band assembly, detaching said hook and hoop fasteners of said second band of said lower band assembly, and continuing to lift said other end of said second band of said lower band assembly until said cam buckle of said second band of said lower band assembly disengages from said hook of said second band of said lower band assembly.

8. The system as defined in claim 1, wherein said upper band assembly further comprises an adaptor for securing the pair of main scuba tanks to an upper portion of a backpack; said lower band assembly further comprising an adapter for securing the pair of main scuba tanks to a lower portion of the backpack.

9. The system as defined in claim 8, wherein said adaptor of said upper band assembly comprises a nose wall that is convexo-concave-shaped for abutting against the upper portion of the backpack and has a throughbore that passes centrally therethrough for alignment with said centrally-disposed throughbore in said one end wall of said pair of opposing end walls of said bracket of said upper band assembly, a pair of side walls that converge from said nose wall of said adapter of said upper band assembly, at its ends, and a pair of base walls that are coplanar and extend inwardly from said pair of side walls of said adapter of said upper band assembly, at its ends, with each base wall of said pair of base walls of said adapter of said upper band assembly having a pair of throughbores for alignment with said four throughbores in said one end wall of said pair of opposing end walls of said bracket of said upper band assembly, and are maintained thereat by four nuts and bolts passing therethrough.

10. The system as defined in claim 8, wherein said adaptor of said lower band assembly comprises a nose wall that is convexo-concave-shaped for abutting against the lower portion of the backpack and has a throughbore that passes centrally therethrough for alignment with said centrally-disposed throughbore in said one end wall of said pair of opposing end walls of said bracket of said lower band assembly, a pair of side walls that converge from said nose wall of said adapter of said lower band assembly, at its ends, and a pair of base walls that are coplanar and extend inwardly from said pair of side walls of said adapter of said lower band assembly, at its ends, with each base wall of said pair of base walls of said adapter of said lower band assembly having a pair of throughbores for alignment with said four throughbores in said one end wall of said pair of opposing end walls of said bracket of said lower band assembly, and are maintained thereat by four nuts and bolts passing therethrough.

* * * * *